US011454902B2

(12) United States Patent
Soda

(10) Patent No.: US 11,454,902 B2
(45) Date of Patent: Sep. 27, 2022

(54) IMAGE FORMING APPARATUS

(71) Applicant: KYOCERA Document Solutions Inc., Osaka (JP)

(72) Inventor: Tomohisa Soda, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/541,225

(22) Filed: Dec. 2, 2021

(65) Prior Publication Data

US 2022/0187736 A1 Jun. 16, 2022

(30) Foreign Application Priority Data

Dec. 10, 2020 (JP) ..... JP2020-204811

(51) Int. Cl.
*G03G 15/08* (2006.01)

(52) U.S. Cl.
CPC ..... *G03G 15/0877* (2013.01); *G03G 15/0808* (2013.01); *G03G 15/0862* (2013.01); *G03G 15/0889* (2013.01)

(58) Field of Classification Search
CPC ..... G03G 15/0808; G03G 15/0849; G03G 15/0856; G03G 15/0862; G03G 15/0867; G03G 15/0877; G03G 15/0889
See application file for complete search history.

(56) References Cited

U.S. PATENT DOCUMENTS 10,877,423 B2 * 12/2020 Kai ..... G03G 15/556
2019/0187603 A1 6/2019 Soda ..... 15/556
2019/0286041 A1 * 9/2019 Soda ..... G03G 15/0121

FOREIGN PATENT DOCUMENTS

JP 2019-109326 A 7/2019

* cited by examiner

*Primary Examiner* — Hoang X Ngo
(74) *Attorney, Agent, or Firm* — Stein IP, LLC

(57) ABSTRACT

An image forming apparatus includes a developing device, a first container, a second container, and a toner supplying device. The toner supplying device includes first and second conveyance members that convey the toner in the first and second containers, and first and second sensing shafts that are used to sense the remaining quantities of toner there. The first and second sensing shafts have a first or second light-shielding plate that moves into and out of the optical path of an optical sensor. Of the first and second light-shielding plates, one rotates together with the first or second conveying member selectively driven and makes contact with the other, and thereby makes it move out of the optical path of the optical sensor.

5 Claims, 9 Drawing Sheets

IMAGE FORMING APPARATUS

INCORPORATION BY REFERENCE

This application is based on and claims the benefit of priority from Japanese Patent Application No. 2020-204811 filed on Dec. 10, 2020, the contents of which are hereby incorporated by reference.

BACKGROUND

The present invention relates to image forming apparatuses.

In image forming apparatuses based on electrophotography, such as copiers and printers, wide use is made of devices that develop with toner an electrostatic latent image formed on the surface of a photosensitive drum as an image carrying member, thereby to form a toner image to be later transferred to a sheet.

For example, some conventional image forming apparatuses include a first toner container and a second toner container that store toner to be supplied to one developing device. On such image forming apparatuses, when one toner container becomes empty, toner can be supplied to the developing device from the other toner container. This helps reduce the frequency with which, and the time for which, image forming operation has to be suspended for replacement of toner containers.

SUMMARY

According to one aspect of the present disclosure, an image forming apparatus includes a developing device, a first container, a second container, a toner supplying device, and a remaining quantity sensing portion. The developing device feeds toner to an image carrying member. The first and second containers each store toner to be supplied to the developing device. The toner supplying device supplies the toner in the first and second containers to the developing device. The remaining quantity sensing portion senses the remaining quantities of toner in the first and second containers. The toner supplying device includes a supply pipe, a first conveyance pipe, a second conveyance pipe, a first conveyance member, a second conveyance member, a clutch, a first sensing shaft, a second sensing shaft, and an optical sensor. The supply pipe, which is provided singly, is connected to the developing device, and through it the toner passes into the developing device. The first conveyance pipe is connected between the first container and the supply pipe, and through it the toner is conveyed from the first container toward the supply pipe. The second conveyance pipe is connected between the second container and the supply pipe, and through it the toner is conveyed from the second container toward the supply pipe. The first conveyance member is rotatably disposed inside the first conveyance pipe, and conveys the toner from the first container toward the supply pipe. The second conveyance member is rotatably disposed inside the second conveyance pipe, and conveys the toner from the second container toward the supply pipe. The clutch enables selectively one of the first and second conveyance members to be driven. The first sensing shaft is coupled to the first conveyance member to rotate together with it. The second sensing shaft is coupled to the second conveyance member to rotate together with it. The optical sensor, which is provided singly, senses the rotation of the first and second sensing shafts. The remaining quantity sensing portion counts the numbers of revolutions of the first and second sensing shafts based on the output signal from the optical sensor and, based on the numbers of revolutions, senses the remaining quantities of toner in the first and second containers. The first sensing shaft has a first light-shielding plate that moves into and out of the optical path of the optical sensor. The second sensing shaft has a second light-shielding plate that moves into and out of the optical path of the optical sensor. One of the first and second light-shielding plates rotates together with the first or second conveying member driven by the clutch and makes contact with the other of the first and second light-shielding plates, thereby to make the other of the first and second light-shielding plates move out of the optical path of the optical sensor.

DETAILED DESCRIPTION

An embodiment of the present disclosure will be described below with reference to the accompanying drawings. The following description is not meant to limit the scope of the present disclosure.

Figure 1:
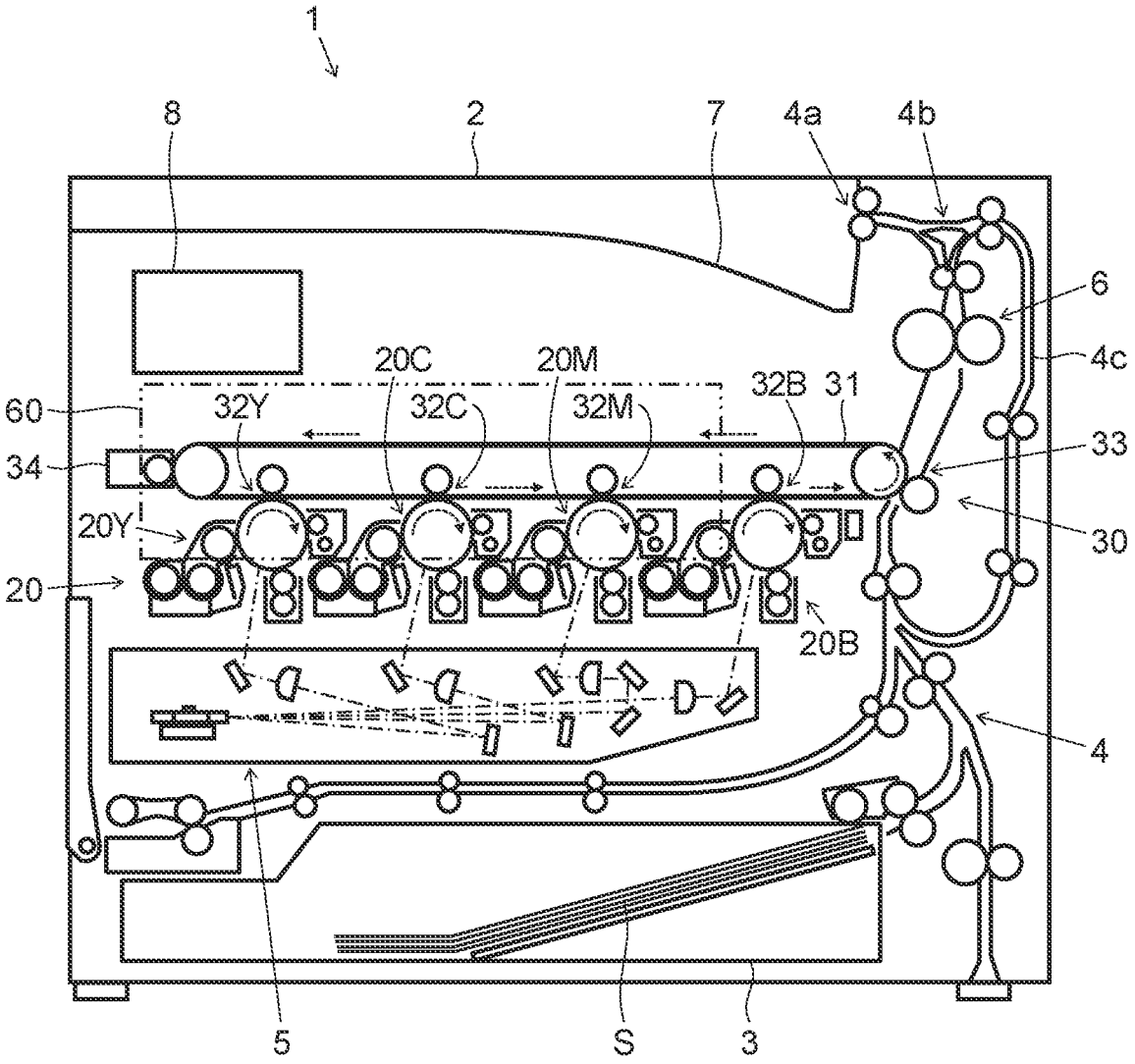
FIG. 1 is a schematic sectional view of an image forming apparatus 1 according to one embodiment of the present disclosure, showing its construction.
Figure 2:
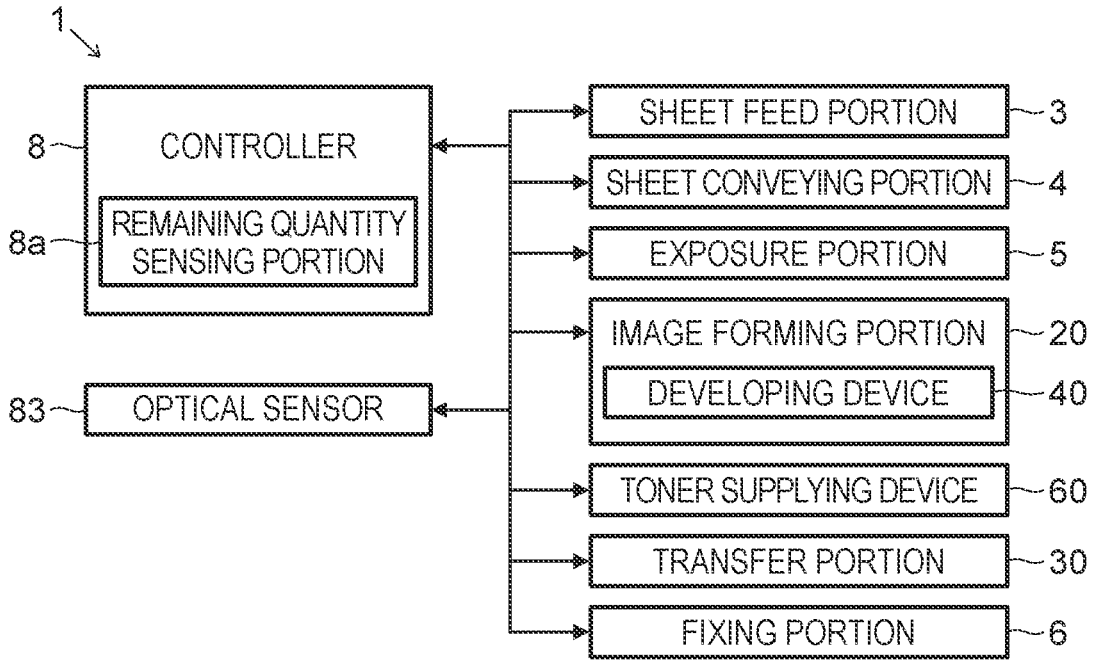
FIG. 2 is a block diagram showing an outline of the configuration of the image forming apparatus 1 in FIG. 1.
Figure 3:
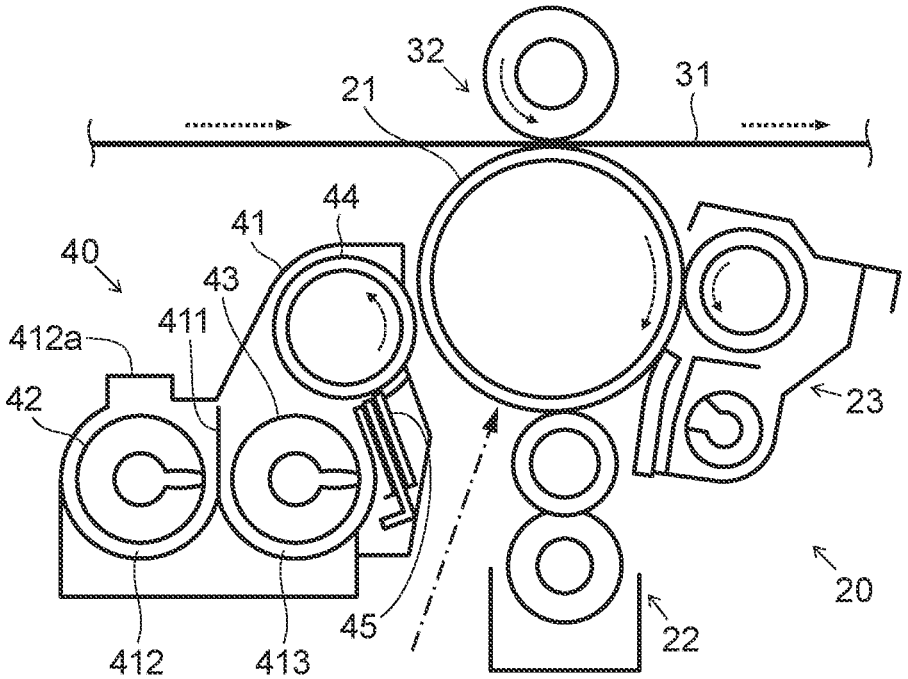
FIG. 3 is a sectional view of and around an image forming portion in the image forming apparatus 1 in FIG. 1.

FIG. 1 is a schematic sectional view of an image forming apparatus 1 according to one embodiment of the present disclosure, showing its construction. FIG. 2 is a block diagram showing an outline of the configuration of the image forming apparatus 1 in FIG. 1. FIG. 3 is a sectional view of and around an image forming portion 20 in the image forming apparatus 1 in FIG. 1. One example of the image forming apparatus 1 according to this embodiment is a tandem-type color printer that transfers a toner image to a sheet S with an intermediate transfer belt 31. The image forming apparatus 1 can be what is called a multifunction peripheral provided with, for example, printing, scanning (image reading), facsimile transmitting, and other functions.

As shown in FIGS. 1, 2, and 3, the image forming apparatus 1 includes, housed inside its main body 2, a sheet feed portion 3, a sheet conveying portion 4, an exposure portion 5, an image forming portion 20, a transfer portion 30, a fixing portion 6, a sheet discharge portion 7, and a controller 8.

The sheet feed portion 3 stores a plurality of sheets S, and during printing feeds out the sheets S one by one separately. The sheet conveying portion 4 conveys a sheet S fed out from the sheet feed portion 3 to a secondary transfer portion 33 and then to the fixing portion 6, and then discharges the sheet S having undergone fixing through a sheet discharge port 4*a* into the sheet discharge portion 7. In duplex printing, the sheet conveying portion 4 distributes, with a branch portion 4*b*, a sheet S having undergone fixing on the first side to a reversing conveyance portion 4*c*, so as to convey the sheet S once again to the secondary transfer portion 33 and then to the fixing portion 6. The exposure portion 5 shines laser light controlled based on image data toward the image forming portion 20.

The image forming portion 20 is disposed under the intermediate transfer belt 31. The image forming portion 20 includes an image forming portion 20Y for yellow, an image forming portion 20C for cyan, an image forming portion 20M for magenta, and an image forming portion 20B for black. These four image forming portions 20 basically have the same structure. Accordingly, in the following description, the designations "Y," "C," "M," and "B" for different colors are often omitted unless distinction is necessary.

As shown in FIG. 3, the image forming portion 20 includes a photosensitive drum (image carrying member) 21 that is supported so as to be rotatable in a predetermined direction (in FIG. 3, clockwise). The image forming portion 20 further includes, around the photosensitive drum 21 along its rotation direction, a charging portion 22, a developing device 40, and a drum cleaning portion 23. Between the developing device 40 and the drum cleaning portion 23, a primary transfer portion 32 is disposed.

The photosensitive drum 21 has a photosensitive layer on its circumferential surface. The charging portion 22 electrostatically charges the circumferential surface of the photosensitive drum 21 to a predetermined potential. The exposure portion 5 exposes to light the circumferential surface of the photosensitive drum 21 electrostatically charged by the charging portion 22, and thereby forms an electrostatic latent image on the circumferential surface of the photosensitive drum 21. The developing device 40 develops the electrostatic latent image by attaching toner to it, and thereby forms a toner image. The four image forming portions 20 form toner images of different colors respectively. The drum cleaning portion 23 performs cleaning by removing the toner and other residues that are left behind on the circumferential surface of the photosensitive drum 21 after the primary transfer of the toner image to the circumferential surface of the intermediate transfer belt 31. In this way the image forming portion 20 performs image formation on the sheet S.

As shown in FIG. 1, the transfer portion 30 includes an intermediate transfer belt 31, primary transfer portions 32Y, 32C, 32M, and 32B, a secondary transfer portion 33, and a belt cleaning portion 34. The intermediate transfer belt 31 is disposed over the four image forming portions 20. The intermediate transfer belt 31 is an intermediate transfer member that is supported so as to be rotatable in a predetermined direction (in FIG. 1, counter-clockwise) and on which the toner images formed in the four image forming portions 20 respectively are primarily transferred sequentially so as to be overlayed on each other. The four image forming portions 20 are disposed in a. row from upstream to downstream in the rotation direction of the intermediate transfer belt 31, that is, in what is called a tandem arrangement.

The primary transfer portions 32Y, 32C, 32M, and 32B are disposed over the image forming portions 20Y, 20C, 20M, and 20B of the corresponding colors across the intermediate transfer belt 31. The secondary transfer portion 33 is disposed, with respect to the sheet conveying portion 4, upstream of the fixing portion 6 in the sheet conveyance direction and, with respect to the transfer portion 30, downstream of the image forming portions 20Y, 20C, 20M, and 20B in the rotation direction of the intermediate transfer belt 31. The belt cleaning portion 34 is disposed upstream of the image forming portions 20Y, 20C, 20M, and 20B in the rotation direction of the intermediate transfer belt 31.

The toner images are, in the primary transfer portions 32Y, 32C, 32M, and 32B of the corresponding colors, primarily transferred to the circumferential surface of the intermediate transfer belt 31. As the intermediate transfer belt 31 rotates, with predetermined timing the toner images in the four image forming portions 20 are transferred to the intermediate transfer belt 31 sequentially so as to be overlayed on each other, so that, on the circumferential surface of the intermediate transfer belt 31, a color toner image having the toner images of the four colors, namely yellow, cyan, magenta, and black, overlaid on each other is formed.

The color toner image on the circumferential surface of the intermediate transfer belt 31 is transferred to a sheet S that is fed synchronously by the sheet conveying portion 4 at a secondary transfer nip formed in the secondary transfer portion 33. The belt cleaning portion 34 performs cleaning by removing the toner and other residues that are left behind on the circumferential surface of the intermediate transfer belt 31 after second transfer.

The fixing portion 6 is disposed over the secondary transfer portion 33. The fixing portion 6 heats and presses the sheet S having the toner image transferred to it, and thereby fixes the toner image to the sheet S.

The sheet discharge portion 7 is disposed above the transfer portion 30. The sheet S that has the toner image fixed to it and thus has completed being printed is conveyed to the sheet discharge portion 7.

The controller 8 includes a CPU, an image processing portion, a storage portion, and other electronic circuits and electronic components (none of which are illustrated). The CPU controls the operation of different components provided in the image forming apparatus 1 based on control programs and control data stored in the storage portion, and thereby performs operation to carry out the functions of the image forming apparatus 1. The sheet feed portion 3, the sheet conveying portion 4, the exposure portion 5, the image forming portion 20, the transfer portion 30, and the fixing portion 6 are individually instructed by the controller 8 to perform printing on the sheet S in a coordinated manner. The storage portion is configured, for example, as a combination of a nonvolatile storage device, such as a program ROM (read-only memory) and a data ROM, and a volatile storage device, such as a RAM (random-access memory).

Next, the structure of and around the developing device 40 will be described with reference to FIG. 3. The developing devices 40 for different colors basically have the same structure, and accordingly for their components no designations for different colors are used and no overlapping description will be repeated.

The developing device 40 feeds toner to the circumferential surface of the photosensitive drum 21. The developing device 40 includes a developer container 41, a first stirring-conveying member 42, a second stirring-conveying member 43, a developing roller 44, and a restricting member 45.

The developer container 41 has an elongate shape extending along the axial direction of the photosensitive drum 21 (the near-far direction with respect to the plane of FIG. 3), and is disposed with its longitudinal direction aligned horizontally. The developer container 41 stores as developer, for example, a magnetic one-component developer containing magnetic toner. The developer may instead be a non-magnetic one-component developer, or a two-component developer containing toner and magnetic carrier. The developer container 41 has a partition 411, a first conveyance chamber 412, and a second conveyance chamber 413.

The partition 411 is disposed in a lower part inside the developer container 41. The partition 411 is disposed in a lower part of the developer container 41, substantially in a middle part in the direction (the left-right direction in FIG. 3) intersecting with the axial direction, and extends in the axial direction and in the up-down direction. The partition 411 divides the interior of the developer container 41 in the direction (the left-right direction in FIG. 3) intersecting with the axial direction. The developer container 41 has, in opposite end parts of the partition 411 in the axial direction (the near-far direction with respect to the plane of FIG. 3), communication portions (not illustrated) through which the first and second conveyance chambers 412 and 413 communicate with each other.

The first and second conveyance chambers 412 and 413 are provided inside the developer container 41. The first and second conveyance chambers 412 and 413 are formed as a result of the interior of the developer container 41 being divided by the partition 411, and are located side by side. The second conveyance chamber 413 is disposed inside the developer container 41, adjacent from below to the space where the developing roller 44 is disposed. The first conveyance chamber 412 is disposed inside the developer container 41, in a space farther away, than the second conveyance chamber 413, from the developing roller 44. The first conveyance chamber 412 is supplied with toner through a supply pipe connection portion 412*a* shown in FIG. 3.

The first stirring-conveying member 42 is disposed inside the first conveyance chamber 412. The second stirring-conveying member 43 is disposed inside the second conveyance chamber 413. The second stirring-conveying member 43 lies close to and extends parallel to the developing roller 44. The first and second stirring-conveying members 42 and 43 are supported on the developer container 41 so as to be rotatable about axes extending parallel to the photosensitive drum 21. By rotating about those axes the first and second stirring-conveying members 42 and 43 convey, while stirring, developer in directions opposite to each other.

As the first and second stirring-conveying members 42 and 43 rotate, the developer circulates between the first and second conveyance chambers 412 and 413 through the communication portions disposed in opposite end parts of the partition 411 in the axial direction. In the first and second conveyance chambers 412 and 413, the toner supplied from outside is stirred and electrostatically charged.

The developing roller 44 is disposed inside the developer container 41, over the second stirring-conveying member 43. The developing roller 44 is supported on the developer container 41 so as to be rotatable about an axis extending parallel to the axis of the photosensitive drum 21. The developing roller 44 includes, for example, a development sleeve in a cylindrical shape that rotates counter-clockwise in FIG. 3 and development roller-side magnetic poles that are fixed inside the development sleeve (of which none are illustrated).

Part of the circumferential surface of the developing roller 44 is exposed out of the developer container 41 so as to face and lie close to the photosensitive drum 21. The developing roller 44 carries on its circumferential surface the toner to be fed, in a region on it facing the photosensitive drum 21. to the circumferential surface of the photosensitive drum 21 in a region. The developing roller 44 attaches the toner in the second conveyance chamber 413 to an electrostatic latent image on the circumferential surface of the photosensitive drum 21, and thereby forms a toner image.

The restricting member 45 is disposed upstream, in the rotation direction of the developing roller 44, of a region where the developing roller 44 and the photosensitive drum 21 face each other. The restricting member 45 lies close to and faces the developing roller 44, with a predetermined gap left between the tip end of the restricting member 45 and the circumferential surface of the developing roller 44. The restricting member 45 extends over the entire area of the developing roller 44 in its axial direction (the near-far direction with respect to the plane of FIG. 3). The restricting member 45 restricts the thickness of the layer of developer (toner) carried on the circumferential surface of the developing roller 44.

The toner in the developer container 41 is stirred and circulated by the first and second stirring-conveying members 42 and 43 so as to be electrostatically charged, and is then delivered by the second stirring-conveying member 43 to the circumferential surface of the developing roller 44. The toner has its layer thickness restricted by the restricting member 45, and is then conveyed, as the developing roller 44 rotates, to the region where the developing roller 44 and the photosensitive drum 21 face each other. When a predetermined developing voltage is applied to the developing roller 44, the potential difference from the circumferential surface of the photosensitive drum 21 causes the toner carried on the circumferential surface of the developing roller 44 to fly through the development space to the circumferential surface of the photosensitive drum 21, and thereby the electrostatic latent image on the circumferential surface of the photosensitive drum 21 is developed.

Figure 4:
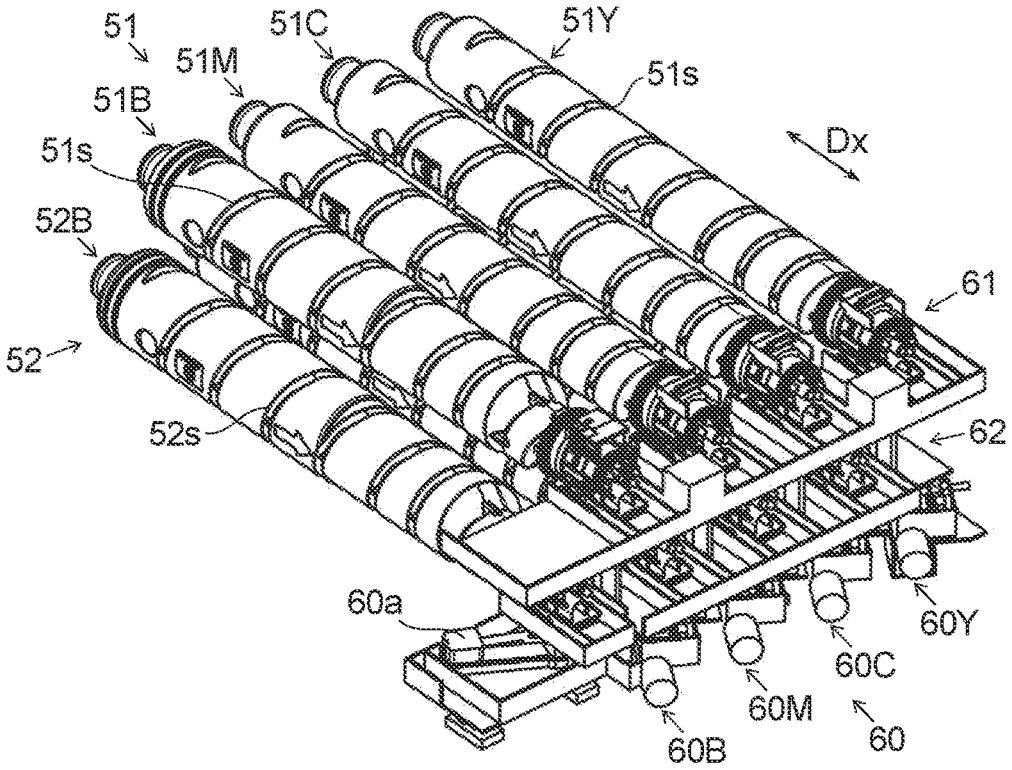
FIG. 4 is a perspective view of and around a toner supplying device in the image forming apparatus 1 in FIG. 1.

For the supplying of toner to the developing device 40, the image forming apparatus 1 includes a first container 51, a second container 52, and a toner supplying device 60 (see FIG. 4). The first container 51, the second container 52, and the toner supplying device 60 are disposed over the developing device 40. One each of the first container 51, the second container 52, and the toner supplying device 60 is provided for each of four colors, namely yellow, cyan, magenta, and black.

Figure 5:
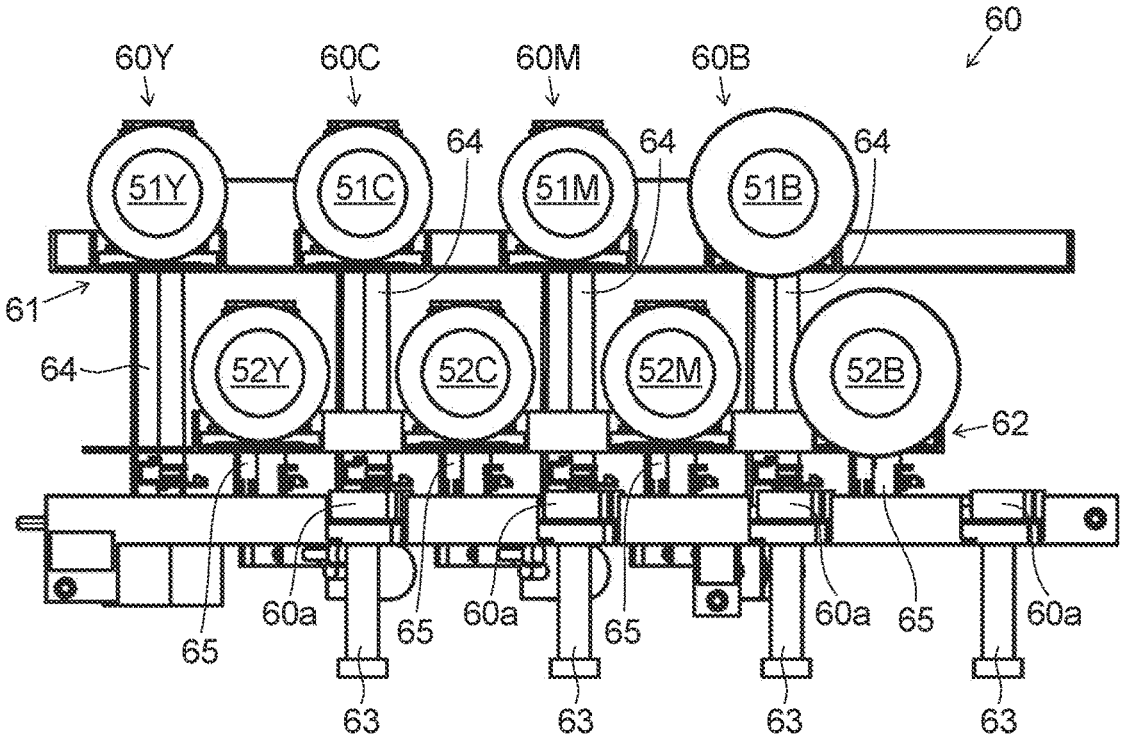
FIG. 5 is a front view of and around the toner supplying device in FIG. 4.
Figure 6:
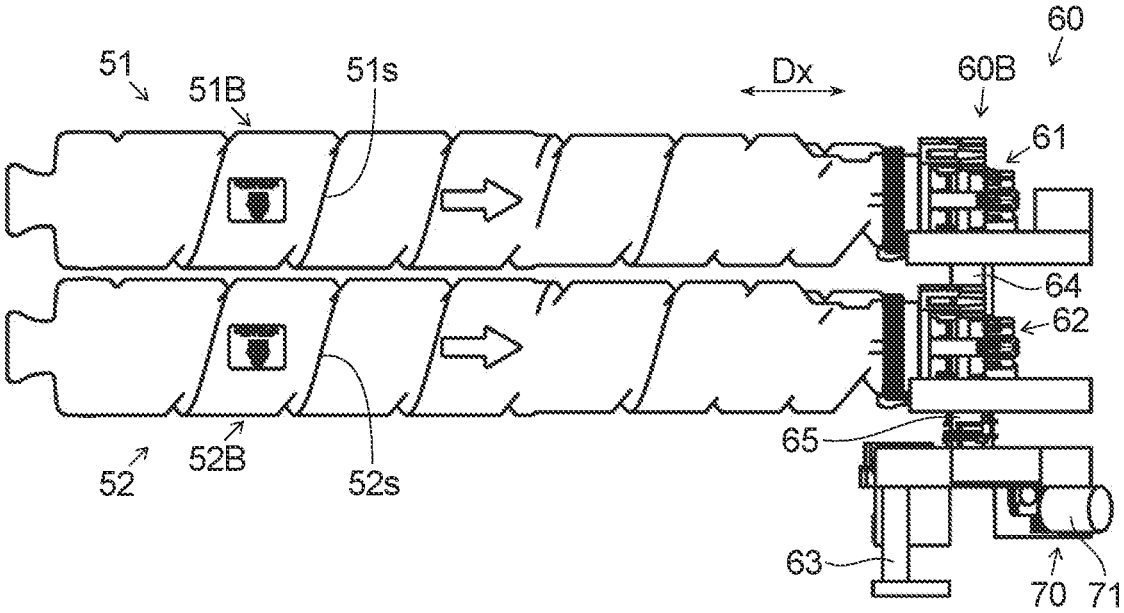
FIG. 6 is a side view of and around the toner supplying device in FIG. 4.
Figure 7:
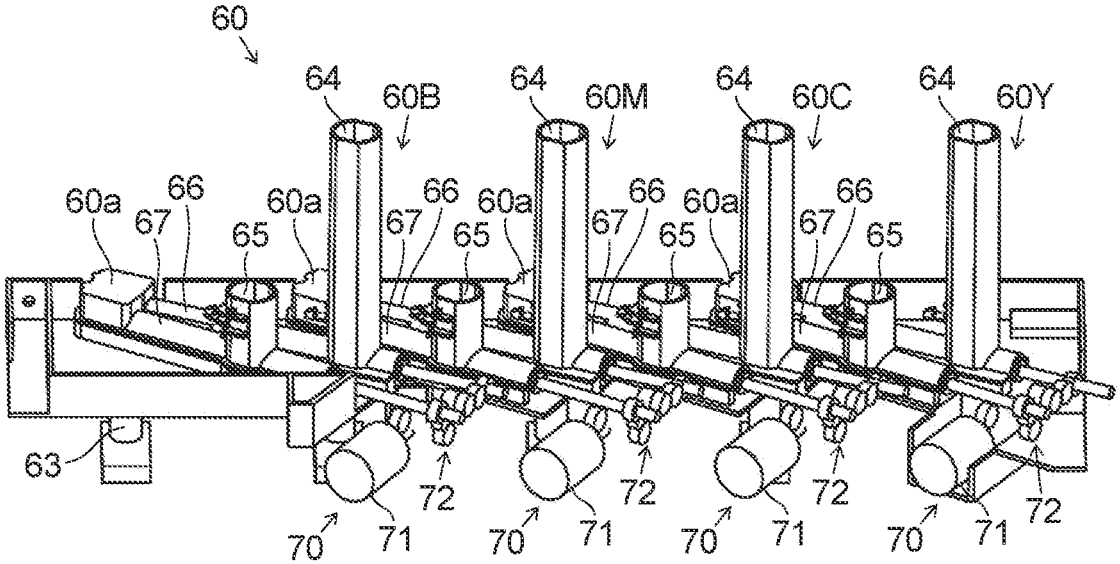
FIG. 7 is a perspective view of the toner supplying device in FIG. 4.
Figure 8:
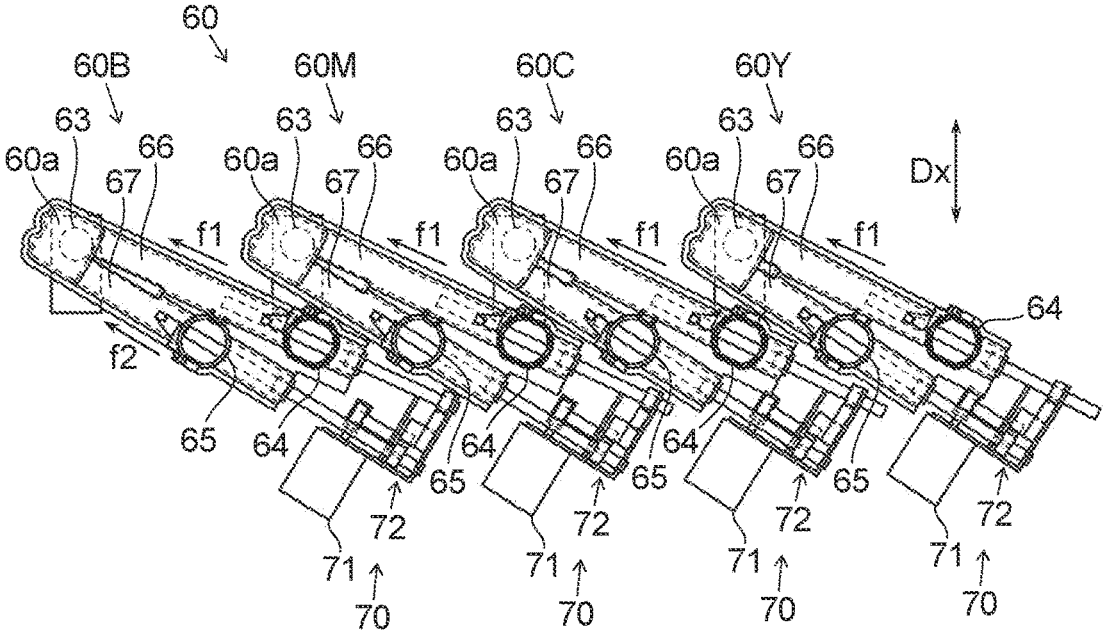
FIG. 8 is a plan view of the toner supplying device in FIG. 4.
Figure 9:
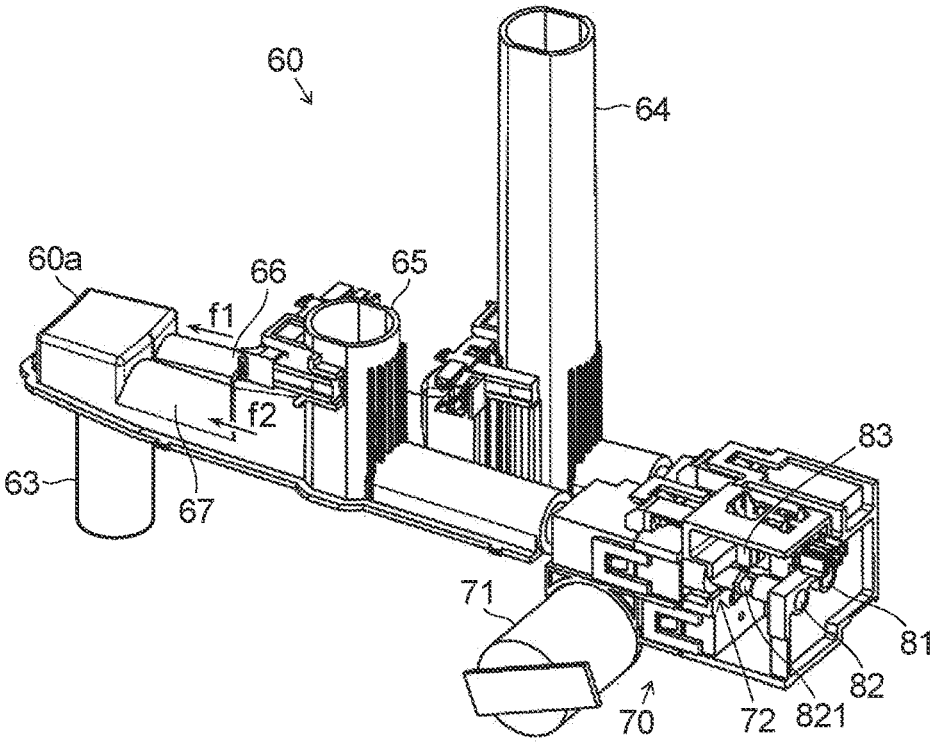
FIG. 9 is a perspective view of a first conveyance pipe and a second conveyance pipe in the toner supplying device in FIG. 7.
Figure 10:
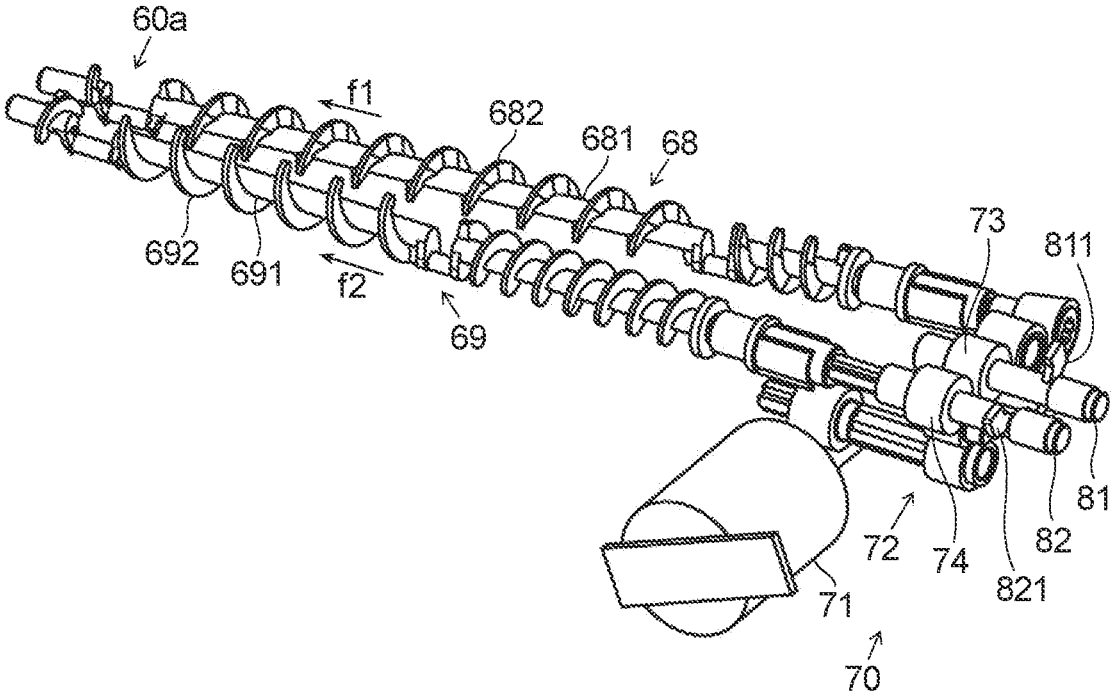
FIG. 10 is a perspective view of a first conveyance member and a second conveyance member in the toner supplying device in FIG. 9.
Figure 11:
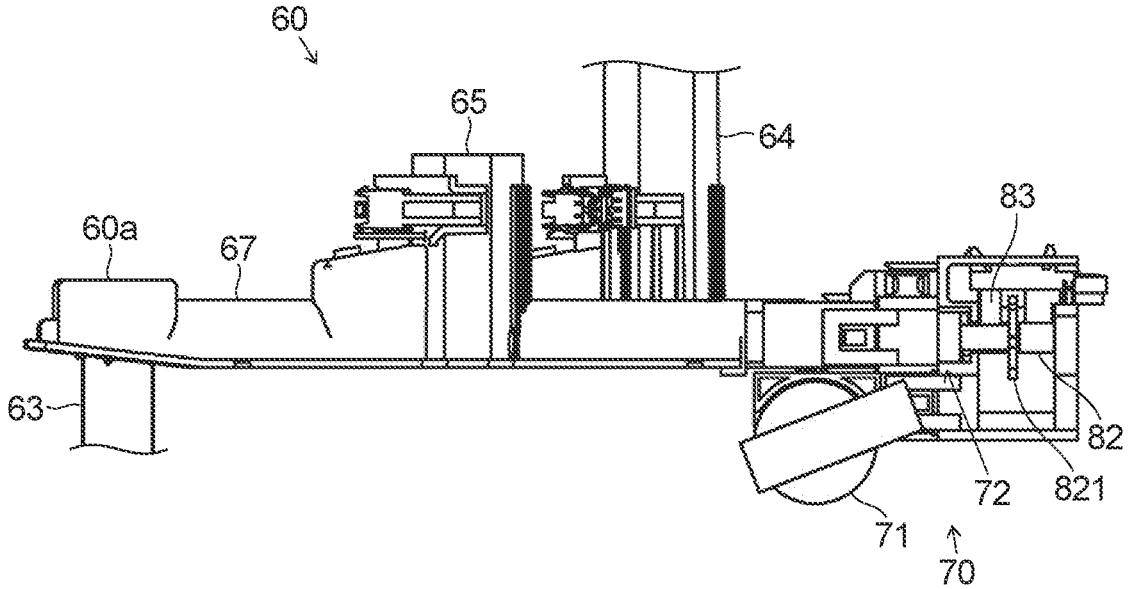
FIG. 11 is a side view of the first conveyance pipe and the second conveyance pipe in the toner supplying device in FIG. 9.
Figure 12:
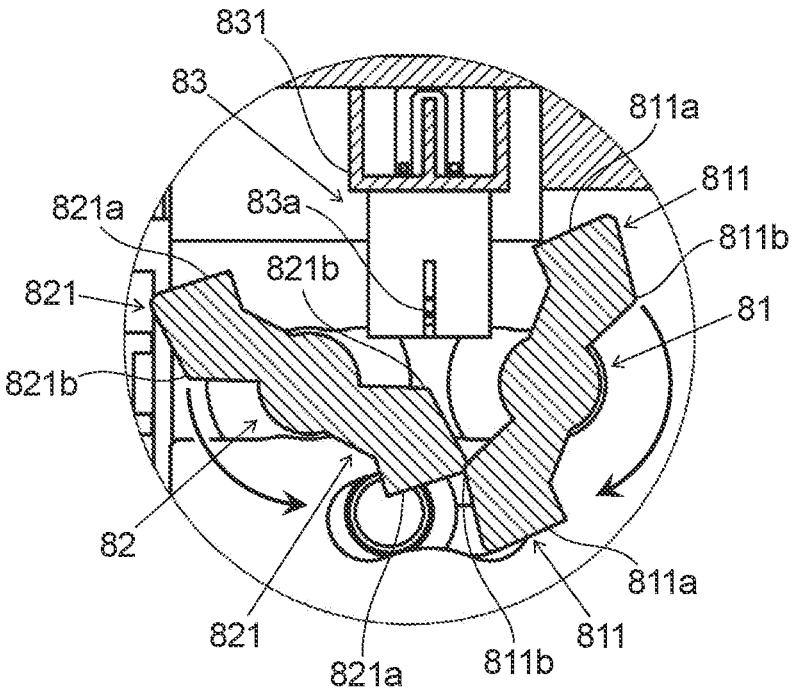
FIG. 12 is a sectional rear view of a first sensing shaft, a second sensing shaft, and an optical sensor in the toner supplying device in FIG. 9.

Next, the structure of and around the toner supplying device 60 will be described with reference to FIGS. 4 to 12. FIG. 4 is a perspective view of and around the toner supplying device 60 in the image forming apparatus 1 in FIG. 1. FIG. 5 is a front view of and around the toner supplying device 60 in FIG. 4. FIG. 6 is a side view of and around the toner supplying device 60 in FIG. 4. FIG. 7 is a perspective view of the toner supplying device 60 in FIG. 4. FIG. 8 is a plan view of the toner supplying device 60 in FIG. 4. FIG. 9 is a perspective view of a first conveyance pipe 66 and a second conveyance pipe 67 in the toner supplying device 60 in FIG. 7. FIG. 10 is a perspective view of a first conveyance member 68 and a second conveyance member 69 in the toner supplying device 60 in FIG. 9. FIG. 11 is a side view of the first conveyance pipe 66 and the second conveyance pipe 67 in the toner supplying device 60 in FIG. 9. FIG. 12 is a sectional rear view of a first sensing shaft 81, a second sensing shaft 82, and an optical sensor 83 in the toner supplying device 60 in FIG. 9.

The first container 51, the second container 52, and the toner supplying device 60 include a first container 51Y, a second container 52Y, and a toner supplying device 60Y for yellow; a first container 51C, a second container 52C, and a toner supplying device 60C for cyan; a first container 51M, a second container 52M, and a toner supplying device 60M for magenta; and a first container 51B, a second container 52B, and a toner supplying device 60B for black. These first containers 51, second containers 52, and toner supplying devices 60 for different colors basically have the same structures. Accordingly, in the following description, the designations "Y," "C," "M," and "B" for different colors are often omitted unless distinction is necessary.

The first container 51 is disposed above the second container 52. The second container 52 is disposed below the first container 51. The first and second containers 51 and 52 are disposed deviated from each other in the direction in which the image forming portions 20 and the toner supplying devices 60 are arrayed. The first and second containers 51 and 52 are mountable/dismountable with respect to the main body 2, and store toner to be supplied to the developing device 40.

The first and second containers 51 and 52 are each in an elongate cylindrical shape extending along the axial direction Dx of the photosensitive drum 21, and are disposed with their longitudinal direction aligned horizontally. On the circumferential walls of the first and second containers 51 and 52, protruding portions 51*s* and 52*s* in helical shapes are formed that protrude inward in the radial direction and that extend in the longitudinal direction.

The first and second containers 51 and 52 are closed at one ends (at the front side) in the axial direction Dx and have openings (not illustrated') at the other ends (at the rear side) in that direction. The first and second containers 51 and 52 are, at the rear side, that is, at the open side, connected to a first container connection portion 61 and a second container connection portion 62. The first and second containers 51 and 52 are supported on the toner supplying device 60 so as to be rotatable about axis extending parallel to the axial direction Dx of the photosensitive drum 21.

The first and second containers 51 and 52 are rotated by a drive portion (not illustrated) to rotate about axes extending parallel to the axial direction Dx of the photosensitive drum 21. As the first and second containers 51 and 52 rotate, the toner inside them are fed toward the rear side, that is, to the open side, by the helical-shaped protruding portions 51*s* and 52*s*. Thus the toner in the first and second containers 51 and 52 passes through the openings into the toner supplying device 60.

The toner supplying device 60 is disposed at the rear side of the first and second containers 51 and 52. The four toner supplying devices 60 are disposed side by side in a row, in the same order as the four image forming portions 20. The toner supplying device 60 supplies the toner in the first and second containers 51 and 52 to the developing device 40.

The toner supplying device 60 includes a. first container connection portion 61, a second container connection portion 62, a supply pipe 63, a first vertical pipe 64, a second vertical pipe 65, a first conveyance pipe 66, a second conveyance pipe 67, a first conveyance member 68, a second conveyance member 69, a conveyance drive portion 70, a first sensing shaft 81, a second sensing shaft 82, and an optical sensor 83.

The first container connection portion 61 is disposed in an upper part of the toner supplying device 60, above the second container connection portion 62. The first container connection portion 61 has a toner circulation passage (not illustrated) in it. The first container connection portion 61, with the open side of the first container 51 connected to it, rotatably supports the first container 51. The downstream end of the first container connection portion 61 in the toner circulation direction is connected to the first vertical pipe 64. When the toner in the first container 51 is supplied to the developing device 40, the toner passes from the first container 51 into the first container connection portion 61, and then passes through and out of the first container connection portion 61 toward the first vertical pipe 64.

The second container connection portion 62 is disposed in an upper part of the toner supplying device 60, below the first container connection portion 61. The second container connection portion 62 has a toner circulation passage (not illustrated) in it. The second container connection portion 62, with the open side of the second container 52 connected to it, rotatably supports the second container 52. The downstream end of the second container connection portion 62 in the toner circulation direction is connected to the second vertical pipe 65. When the toner in the second container 52 is supplied to the developing device 40, the toner passes from the second container 52 into the second container connection portion 62, and then passes through and out of the second container connection portion 62 toward the second vertical pipe 65.

The supply pipe 63 is disposed in a lower part of the toner supplying device 60. The toner supplying device 60 has a single supply pipe 63. The supply pipe 63 is formed in a tubular shape extending in the up-down direction. The upper end of the supply pipe 63 is connected to a junction portion 60*a* between the first and second conveyance pipes 66 and 67. The lower end of the supply pipe 63 is connected to the supply pipe connection portion 412*a* of the developing device 40. When the toner in the first and second containers 51 and 52 is supplied to the developing device 40, the toner passes from the junction portion 60*a* into the supply pipe 63, and then passes through the supply pipe 63 into the developing device 40.

The first vertical pipe 64 is disposed between the first container connection portion 61 and the first conveyance pipe 66. The first vertical pipe 64 is formed in a tubular shape extending in the up-down direction. The upper end of the first vertical pipe 64 is connected to the first container connection portion 61. The lower end of the first vertical pipe 64 is connected to the first conveyance pipe 66. When the toner in the first container 51 is supplied to the developing device 40, the toner passes from the first container connection portion 61 into the first vertical pipe 64, and then passes through and out of the first vertical pipe 64 into the first conveyance pipe 66.

The second vertical pipe 65 is disposed between the second container connection portion 62 and the second conveyance pipe 67. The second vertical pipe 65 is formed in a tubular shape extending in the up-down direction. The upper end of the second vertical pipe 65 is connected to the second container connection portion 62. The lower end of the second vertical pipe 65 is connected to the second conveyance pipe 67. When the toner in the second container 52 is supplied to the developing device 40, the toner passes from the second container connection portion 62 into the second vertical pipe 65, and then passes through and out of the second vertical pipe 65 into the second conveyance pipe 67.

Owing to the first container 51 and the first container connection portion 61 being disposed above the second container 52 and the second container connection portion 62, the first vertical pipe 64 is longer than the second vertical pipe 65 in the up-down direction. Owing to the second container 52 and the second container connection portion 62 being disposed below the first container 51 and the first container connection portion 61, the second vertical pipe 65 is shorter than the first vertical pipe 64 in the up-down direction. The first and second vertical pipes 64 and 65 are disposed at the same position in the axial direction Dx of the photosensitive drum 21. In other words, the first and second vertical pipes 64 and 65 are disposed side by side on a straight line orthogonal to the axial direction Dx.

The first conveyance pipe 66 is disposed between the first vertical pipe 64 and the supply pipe 63 in the up-down direction. The first conveyance pipe 66 is formed in a tubular shape extending in the horizontal direction, with the first vertical pipe 64 connected to a part of the first conveyance pipe 66 at one end in its extension direction. A part of the first conveyance pipe 66 at the other end in its extension direction is connected to the junction portion 60*a*. When the toner in the first container 51 is supplied to the developing device 40, the toner passes from the first vertical pipe 64 into the first conveyance pipe 66, and then passes through and out of the first conveyance pipe 66 toward the junction portion 60*a*. In other words, the first conveyance pipe 66 is connected between the first container 51 and the supply pipe 63, so that toner is conveyed from the first container 51 toward the supply pipe 63.

The second conveyance pipe 67 is disposed between the second vertical pipe 65 and the supply pipe 63 in the up-down direction. The second conveyance pipe 67 is formed in a tubular shape extending in the horizontal direction, with the second vertical pipe 65 connected to a part of the second conveyance pipe 67 at one end in its extension direction. A part of the second conveyance pipe 67 at the other end in its extension direction is connected to the junction portion 60*a*. When the toner in the second container 52 is supplied to the developing device 40, the toner passes from the second vertical pipe 65 into the second conveyance pipe 67, and then passes through and out of the second conveyance pipe 67 toward the junction portion 60*a*. In other words, the second conveyance pipe 67 is connected between the second container 52 and the supply pipe 63, so that toner is conveyed from the second container 52 toward the supply pipe 63.

The first and second conveyance pipes 66 and 67 are disposed such that, at the junction portion 60*a* side of their respective extension directions, their extension lines intersect with each other. In other words, the first and second conveyance pipes 66 and 67 are disposed with an acute angle between their respective extension directions on the horizontal plane, that is, in a V shape as seen from the up-down direction.

The first conveyance member 68 is disposed inside the first conveyance pipe 66. The first conveyance member 68 has a rotary shaft 681 disposed between opposite ends of the tubular-shaped first conveyance pipe 66 in its axial direction and a first conveyance blade 682 formed on the circumferential surface of the rotary shaft 681 and extending in a helical shape along the axial direction. The first conveyance member 68 is supported inside the first conveyance pipe 66 so as to be rotatable about an axis extending in the horizontal direction. A part of the first conveyance member 68 at one end is located inside the junction portion 60*a*.

By rotating about its axis the first conveyance member 68 conveys, while stirring, the toner in the first conveyance pipe 66 along a toner conveyance direction f1 (see FIGS. 8, 9, and 10) parallel to the rotation axis. The first conveyance member 68 conveys the toner in the first conveyance pipe 66 from the first vertical pipe 64 toward the junction portion 60*a*. In other words, the first conveyance member 68 conveys toner from the first container 51 toward the supply pipe 63.

The second conveyance member 69 is disposed inside the second conveyance pipe 67. The second conveyance member 69 has a rotary shaft 691 disposed between opposite ends of the tubular-shaped second conveyance pipe 67 in its axial direction and a second conveyance blade 692 formed on the circumferential surface of the rotary shaft 691 and extending in a helical shape along the axial direction. The second conveyance member 69 is supported inside the second conveyance pipe 67 so as to be rotatable about an axis extending in the horizontal direction. A part of the second conveyance member 69 at one end is located inside the junction portion 60*a*.

By rotating about its axis the second conveyance member 69 conveys, while stirring, the toner in the second conveyance pipe 67 along a toner conveyance direction f2 (see FIGS. 8, 9, and 10) parallel to the rotation axis. The second conveyance member 69 conveys the toner in the second conveyance pipe 67 from the second vertical pipe 65 toward the junction portion 60*a*. In other words, the second conveyance member 69 conveys toner from the second container 52 toward the supply pipe 63.

The conveyance drive portion 70 is disposed in a rear part of the toner supplying device 60, upstream of the first and second conveyance pipes 66 and 67 in the toner conveyance directions. The conveyance drive portion 70 generates and transmits a driving force that drives the first and second conveyance members 68 and 69 to rotate. The conveyance drive portion 70 includes a motor 71, a train of gears 72, a first clutch 73, and a second clutch 74.

The motor 71 is coupled to the train of gears 72. The motor 71 generates the driving force that drives the first and second conveyance members 68 and 69 to rotate. The driving force of the motor 71 is transmitted via the train of gears 72 to the first and second conveyance members 68 and 69. The motor 71 is controlled by the controller 8.

The train of gears 72 is coupled to the motor 71 and to the first and second conveyance members 68 and 69. The train of gears 72 is composed of a plurality of gears, and transmits the driving force of the motor 71 to the first and second conveyance members 68 and 69.

The first clutch 73 is disposed in the transmission path of the driving force to the first conveyance member 68. The first clutch 73 is configured as, for example, a one-way clutch, so as to permit the first conveyance member 68 to rotate in the forward direction to convey toner along the toner conveyance direction f1 while restraining it from rotating in the reverse direction.

The second clutch 74 is disposed in the transmission path of the driving force to the second conveyance member 69. The second clutch 74 is configured as, for example, a one-way clutch, so as to permit the second conveyance member 69 to rotate in the forward direction to convey toner along the toner conveyance direction f2 while restraining it from rotating in the reverse direction.

The first and second clutches 73 and 74 enables selectively one of the first and second conveyance members 68 and 69 to be driven. Specifically, in the conveyance drive portion 70, when the motor 71 rotates in a first direction, the first conveyance member 68 rotates in the forward direction to convey toner along the toner conveyance direction f1, while the second conveyance member 69 remains at rest. On the other hand, in the conveyance drive portion 70, when the motor 71 rotates in a second direction, the second conveyance member 69 rotates in the forward direction to convey toner along the toner conveyance direction f2, while the first conveyance member 68 remains at rest.

The first sensing shaft 81 is connected to one of the gears in the train of gears 72. The first sensing shaft 81 is coupled via the train of gears 72 to the first conveyance member 68, and rotates together with the first conveyance member 68. The first sensing shaft 81 rotates in the same direction and at the same rotation speed as the first conveyance member 68. As shown in FIG. 12, the first sensing shaft 81 rotates clockwise as seen from upstream in the toner circulation direction along the first conveyance pipe 66. In this embodiment, the first sensing shaft 81 is adjacent to the second sensing shaft 82, and extends parallel to the second sensing shaft 82.

The first sensing shaft 81 has two first light-shielding plates 811. The two first light-shielding plates 811 extend outward in the radial direction with respect to the first sensing shaft 81, and are disposed at angular intervals of 180 degrees in the circumferential direction. As the first sensing shaft 81 rotates, the first light-shielding plates 811 moves into and out of the optical path of the optical sensor 83.

In this embodiment, the second sensing shaft 82 is connected coaxially to the rotary shaft 691 of the second conveyance member 69. That is, the second sensing shaft 82 is coupled to the second conveyance member 69, and rotates together with the second conveyance member 69. The second sensing shaft 82 rotates in the same direction and at the same rotation speed as the second conveyance member 69. As shown in FIG. 12, the second sensing shaft 82 rotates counter-clockwise as seen from upstream in the toner circulation direction along the second conveyance pipe 67.

The second sensing shaft 82 has two second light-shielding plates 821. The two second light-shielding plates 821 extend outward in the radial direction with respect to the second sensing shaft 82, and are disposed at angular intervals of 180 degrees in the circumferential direction. As the second sensing shaft 82 rotates, the second light-shielding plates 821 moves into and out of the optical path of the optical sensor 83.

The optical sensor 83 is disposed over the space between the first and second sensing shafts 81 and 82. The toner supplying device 60 includes a single optical sensor 83. The optical sensor 83 is, for example, a transmissive optical sensor; it has a light-emitting portion and a light-receiving portion (of which neither is illustrated) and has an optical path from the light-emitting portion to the light-receiving portion. The optical sensor 83 senses the optical path being shielded (light being intercepted) and unshielded (light being transmitted).

The first light-shielding plates 811 of the first sensing shaft 81 and the second light-shielding plates 821 of the second sensing shaft 82 move into and out of the optical path of the optical sensor 83. This enables the optical sensor 83 to sense the rotation of the first and second sensing shafts 81 and 82. The optical sensor 83 outputs to the controller 8 a signal related to the sensing of the rotation of the first and second sensing shafts 81 and 82.

The controller 8 receives the output signal of the optical sensor 83. The controller 8 includes a remaining quantity sensing portion 8*a* shown in FIG. 2. The function of the remaining quantity sensing portion 8*a* is carried out on a software basis through arithmetic processing by the CPU running a program stored in the storage portion. The remaining quantity sensing portion 8*a* may instead be configured on a hardware basis.

Based on the output signal of the optical sensor 83, the remaining quantity sensing portion 8*a* senses the remaining quantities of toner in the first and second containers 51 and 52. Specifically, based on the output signal of the optical sensor 83, the remaining quantity sensing portion 8*a* counts the numbers of revolutions of the first and second sensing shafts 81 and 82, and based on the numbers of revolutions senses the remaining quantities of toner in the first and second containers 51 and 52.

Figure 13:
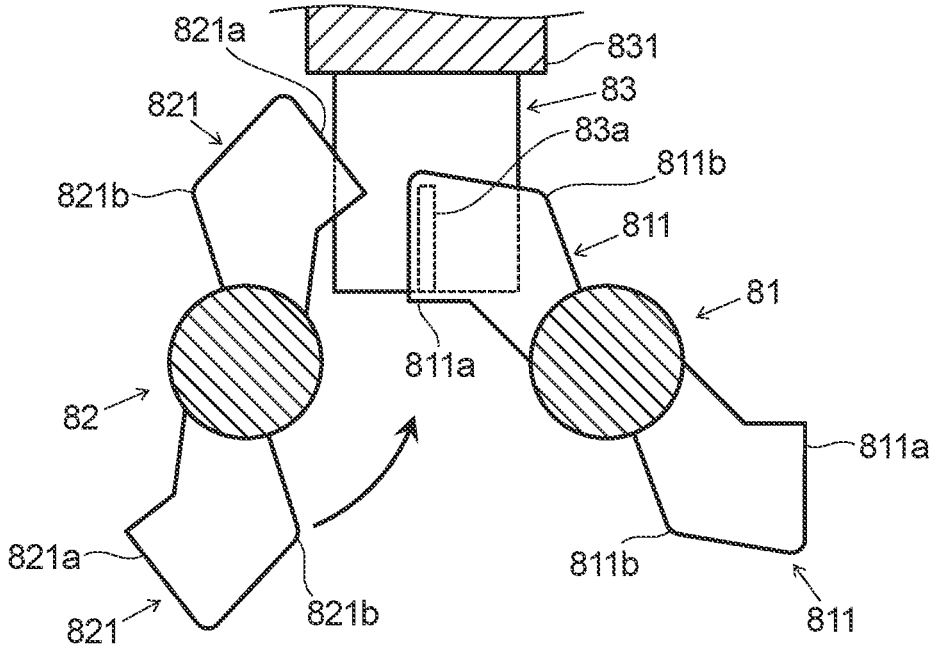
FIG. 13 is a diagram illustrating a rotation state of the first and second sensing shafts in FIG. 12.
Figure 14:
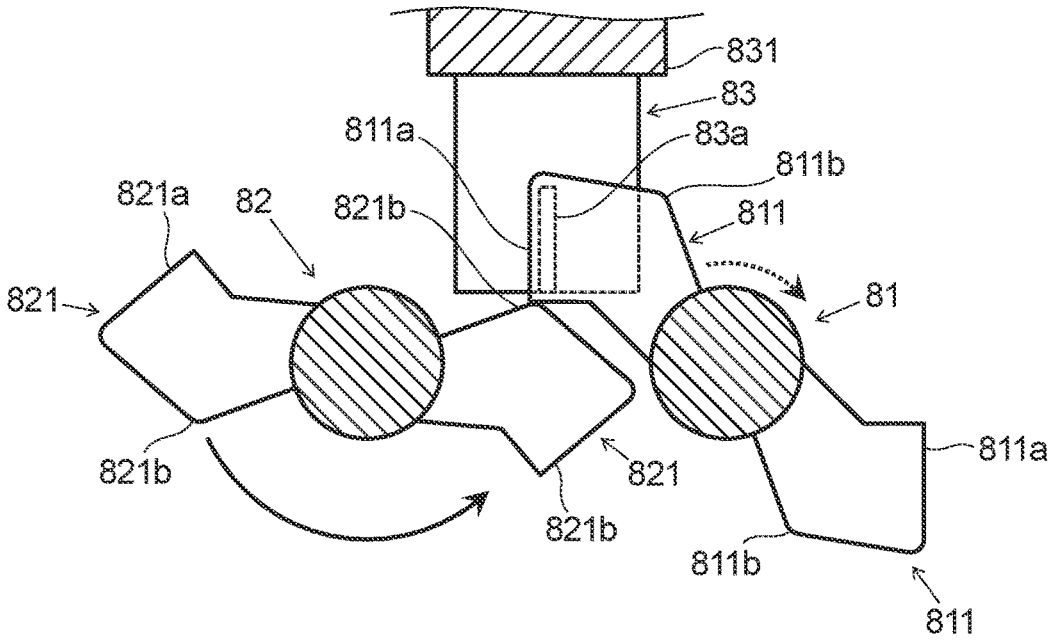
FIG. 14 is a diagram illustrating a rotation state of the first and second sensing shafts in FIG. 12.
Figure 15:
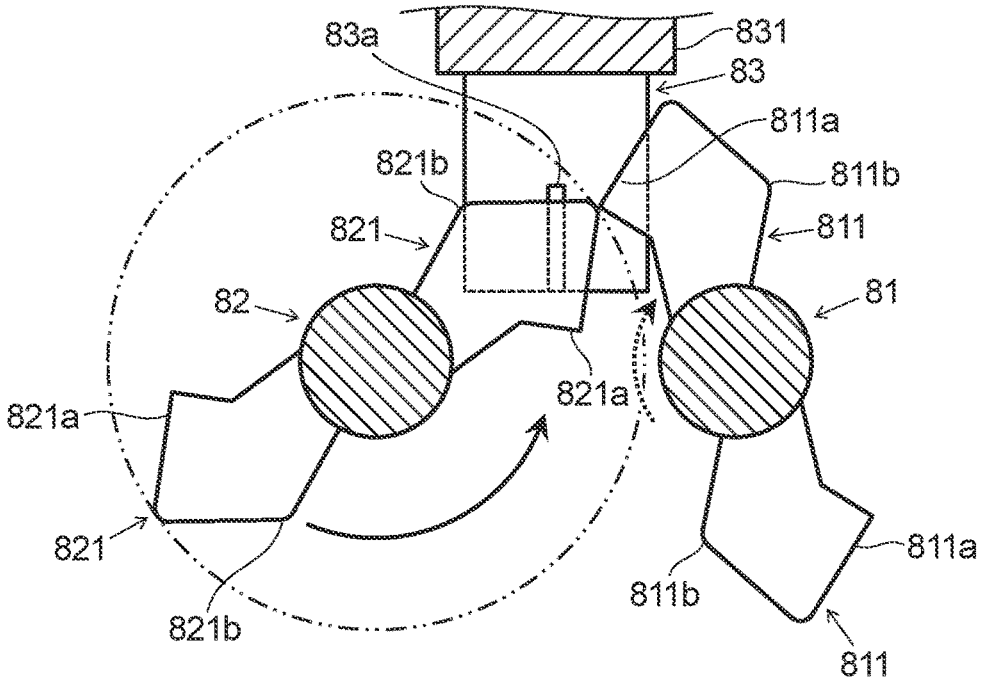
FIG. 15 is a diagram illustrating a rotation state of the first and second sensing shafts in FIG. 12.
Figure 16:
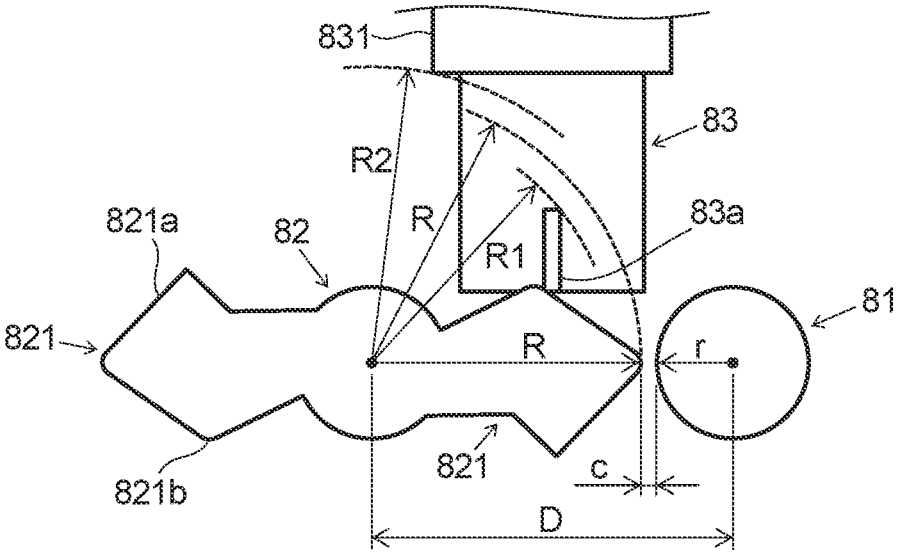
FIG. 16 is a diagram illustrating the structure of the first and second sensing shafts in detail.

Next, the structure of and around the first sensing shaft 81, the second sensing shaft 82, and the optical sensor 83 will be described in detail with reference to, in addition to FIG. 12, FIGS. 13 to 16. FIGS. 13, 14, and 15 are diagrams illustrating the first and second sensing shafts 81 and 82 in FIG. 12 in different rotation states. FIG. 16 is a diagram illustrating the structure of the first and second sensing shafts 81 and 82 in detail.

On the image forming apparatus 1, for example, when the toner in the first container 51 runs out, toner can be supplied from the second container 52 to the developing device 40. The remaining quantity sensing portion 8*a* counts the number of revolutions of the first sensing shaft 81 based on the output signal of the optical sensor 83, and based on the number of revolutions senses the toner in the first container 51 having run out. The controller 8 controls the motor 71 to stop the rotation of the first conveyance member 68 and thereby stops the supply of toner from the first container 51.

For example, when the toner in the first container 51 runs out, as shown in FIG. 13, the first sensing shaft 81 may stop rotating in a state as shown in FIG. 13. In FIG. 13, a first light-shielding plate 811 of the first sensing shaft 81 is in the optical path of the optical sensor 83, shielding the optical path.

Next, the controller 8 controls the motor 71 to start to rotate the second conveyance member 69, and thereby starts the supply of toner from the second container 52. Thus the second sensing shaft 82 rotates together with the second conveyance member 69. Then, as shown in FIG. 14, a second light-shielding plate 821 on the second sensing shaft 82 makes contact with the first light-shielding plate 811 in the optical path of the optical sensor 83.

When the second sensing shaft 82 rotates further, as shown in FIG. 15, the second light-shielding plate 821 moves the first light-shielding plate 811 away so that the first light-shielding plate 811 moves out of the optical path of the optical sensor 83. The first light-shielding plate 811 retracts out of the rotation region of the second light-shielding plates 821 (inside the dash-dot-dot circle in FIG. 15) and is no longer sensed by the optical sensor 83.

Likewise, on the image forming apparatus 1, for example, when the toner in the second container 52 runs out, toner can be supplied from the first container 51 to the developing device 40. In a manner similar to what has been described above, if a second light-shielding plate 821 is located in the optical path of the optical sensor 83, a first light-shielding plate 811 makes contact with the second light-shielding plate 821 and moves it away so that the second light-shielding plate 821 moves out of the optical path of the optical sensor 83.

Thus, rotating together with the first or second conveyance member 68 or 69 driven by the first and second clutches 73 and 74, one of a first light-shielding plate 811 and a second light-shielding plate 821 makes contact with the other and thereby makes this move out of the optical path of the optical sensor 83.

With the structure described above, either a first light-shielding plate 811 or a second light-shielding plate 821 is located in the optical path of the optical sensor 83. That is, with a single optical sensor 83 it is possible to sense the rotation of the first and second light-shielding plates 811 and 821 individually. In this way, with a low-cost, compact structure it is possible to accurately sense the remaining quantities of toner in the two containers (the first and second containers 51 and 52) that supply toner to one developing device 40.

Each first light-shielding plate 811 has a shielding portion 811*a* and a projecting portion 811*b*.

The shielding portion 811*a* is disposed upstream (backward) in the rotation direction of the first light-shielding plate 811. The shielding portion 811*a* is formed in a substantially triangular shape projecting upstream in the rotation direction of the first light-shielding plate 811. As the first light-shielding plate 811 rotates, with predetermined timing the shielding portion 811*a* hides an entire sensing portion 83*a* of the optical sensor 83 (see FIG. 13).

The projecting portion 811*b* is disposed downstream (forward) in the rotation direction of the first light-shielding plate 811. The projecting portion 811*b* is formed in a substantially triangular shape projecting downstream in the rotation direction of the first light-shielding plate 811. In other words, the projecting portion 811*b* projects toward a second light-shielding plate 821 at where the first light-shielding plate 811 and the second light-shielding plate 821 make contact with each other. The projecting portion 811*b* has at its tip end a vertex point or a curved surface.

Each second light-shielding plate 821 has a shielding portion 821*a* and a projecting portion 821*b*.

The shielding portion 821*a* is disposed upstream (backward) in the rotation direction of the second light-shielding plate 821. The shielding portion 821*a* is formed in a substantially triangular shape projecting upstream in the rotation direction of the second light-shielding plate 821. As the second light-shielding plate 821 rotates, with predetermined timing the shielding portion 821*a* hides an entire sensing portion 83*a* of the optical sensor 83.

The projecting portion 821*b* is disposed downstream (forward) in the rotation direction of the second light-shielding plate 821. The projecting portion 821*b* is formed in a substantially triangular shape projecting downstream in the rotation direction of the second light-shielding plate 821. In other words, the projecting portion 821*b* projects toward a first light-shielding plate 811 at where the second light-shielding plate 821 and the first light-shielding plate 811 make contact with each other. The projecting portion 821*b* has at its tip end a vertex point or a curved face.

With the structure described above, owing to the provision of the projecting portions 811*b* and 821*b*, even when the first and second light-shielding plates 811 and 821 make contact with each other, they are prevented from being stuck and locked together to be unable to rotate any more. In this way, with a single optical sensor 83 it is possible to sense the rotation of the first and second light-shielding plates 811 and 821 individually. While providing at least one of the projecting portions 811*b* and 821*b* on the first and second light-shielding plates 811 and 821 suffices, providing both is preferred.

The first sensing shaft 81, the second sensing shaft 82, and the optical sensor 83 are structured as follows: as shown in FIG. 16, let the maximum value of the radius from the rotation axes of the first and second sensing shafts 81 and 82 to the outer ends of the first and second light-shielding plates 811 and 821 in the radial direction be R, let the distance between the rotation axes of the first and second sensing shafts 81 and 82 be D, let the radius of the first and second sensing shafts 81 and 82 be r, let the minimum value of the clearance needed between the first and second sensing shafts 81 and 82 in the radial direction be c, let the distance from the rotation axes to the farthest end of the sensing portion 83*a* of the optical sensor 83 be R1, and let the distance from the rotation axes to the nearest edge of a holding member 831 for the optical sensor 83 be R2, then Expressions (1) and (2) below are both fulfilled. It should be noted that FIG. 16 illustrates the second sensing shaft 82 as a representative, showing only the shaft part of the first sensing shaft 81 for the sake of convenient description.

$$R \leq D - r - c \quad \text{Expression (1)}$$

$$R1 < R < R2 \quad \text{Expression (2)}$$

With this structure, the first and second light-shielding plates 811 and 821 can hide the entire sensing portion 83*a* of the optical sensor 83 without making contact with the holding member 831 for the optical sensor 83. Thus it is possible to enhance the accuracy with which the optical sensor 83 senses the first and second light-shielding plates 811 and 821.

Moreover, the first sensing shaft 81, the second sensing shaft 82, and the optical sensor 83 are preferably so structured that the maximum value R of the radius from the rotation axes of the first and second sensing shafts 81 and 82 to the outer end of the first and second light-shielding plates 811 and 821 in the radial direction fulfill Expressions (3) and (4) below.

$$R = D - r - c \quad \text{Expression (3)}$$

$$R = (R1 + R2)/2 \quad \text{Expression (4)}$$

Using a compact general-purpose optical sensor makes it difficult to fulfill formula (2) above. However, fulfilling both formulae (3) and (4) makes it possible, even in a case where a compact general-purpose optical sensor is used, to stabilize the accuracy with which the optical sensor 83 senses the first and second light-shielding plates 811 and 821 individually.

Figure 17:
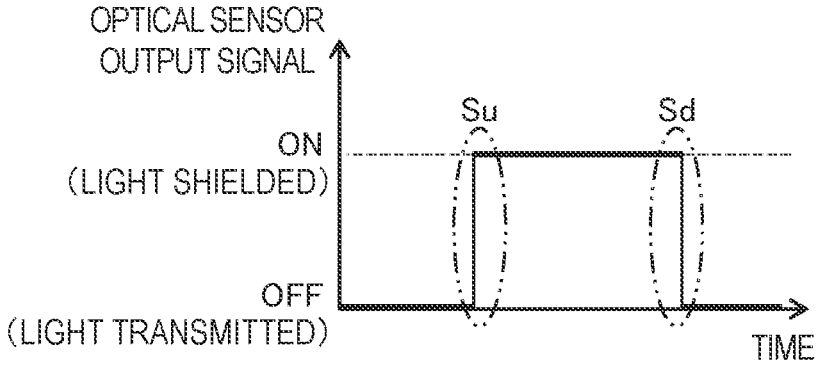
FIG. 17 is a diagram illustrating the counting of the numbers of revolutions of the first and second sensing shafts by the remaining quantity sensing portion in FIG. 2.

FIG. 17 is a diagram illustrating the counting of the numbers of revolutions of the first and second sensing shafts 81 and 82 by the remaining quantity sensing portion 8*a* in FIG. 2. Of the graph shown in FIG. 17, the vertical axis represents the output value of the signal from the optical sensor 83 and the horizontal axis represents time. For example, in this embodiment, the optical sensor 83 is on in a light-shielded state in which the optical path is shielded, and is off in a light-transmitted state in which the optical path is unshielded.

The remaining quantity sensing portion 8*a* counts the numbers of revolutions based on the output signal Su yielded when the optical path of the optical sensor 83 starts being shielded by a light-shielding plate 811 or 812 or based on the output signal Sd yielded when the optical path of the optical sensor 83 ceases being shielded. With this structure, a light-shielding plate 811 or 821 in a stationary state is not sensed; instead, based on the movement of the first and second light-shielding plates 811 and 821, the numbers of revolutions are counted. It is thus possible to properly sense the remaining toner quantities in the first and second containers 51 and 52.

While an embodiment of the present disclosure has been described above, this is in no way meant to limit the scope of what is disclosed herein. The present disclosure can be implemented with many modification made without departure from the spirit of what is disclosed herein.

For example, while the embodiment described above deals with an example where the image forming apparatus 1 is what is called a tandem-type image firming apparatus for color printing that forms images of a plurality of colors in such a manner as to overlay one on another, this is not meant as limitation to similar models. The image forming apparatus may instead be a color-printing image forming apparatus of any other type than a tandem type, or a monochrome printing image forming apparatus.

What is claimed is:

1. An image forming apparatus, comprising:

a developing device that feeds toner to an image carrying member;

a first container and a second container that each store toner to be supplied to the developing device;

a toner supplying device that supplies the toner in the first and second containers to the developing device; and a remaining quantity sensing portion that senses remaining quantities of toner in the first and second containers, wherein the toner supplying device comprises:

a single supply pipe that is connected to the developing device and through which the toner passes into the developing device;

a first conveyance pipe that is connected between the first container and the supply pipe and through which the toner is conveyed from the first container toward the supply pipe;

a second conveyance pipe that is connected between the second container and the supply pipe and through which the toner is conveyed from the second container toward the supply pipe;

a first conveyance member that is rotatably disposed inside the first conveyance pipe and that conveys the toner from the first container toward the supply pipe;

a second conveyance member that is rotatably disposed inside the second conveyance pipe and that conveys the toner from the second container toward the supply pipe;

a clutch that enables selectively one of the first and second conveyance members to be driven, a first sensing shaft that is coupled to the first conveyance member to rotate together with the first conveyance member;

a second sensing shaft that is coupled to the second conveyance member to rotate together with the second conveyance member; and a single optical sensor that senses rotation of the first and second sensing shafts, the remaining quantity sensing portion counts numbers of revolutions of the first and second sensing shafts based on an output signal from the optical sensor and, based on the numbers of revolutions, senses the remaining quantities of toner in the first and second containers, the first sensing shaft has a first light-shielding plate that moves into and out of an optical path of the optical sensor, the second sensing shaft has a second light-shielding plate that moves into and out of the optical path of the optical sensor, one of the first and second light-shielding plates rotates together with the first or second conveying member driven by the clutch and makes contact with another of the first and second light-shielding plates, thereby to make the another of the first and second light-shielding plates move out of the optical path of the optical sensor.

2. An image forming apparatus according to claim 1, wherein of the first and second light-shielding plates, at least one has, in a part thereof making contact with another, a projecting portion that projects toward the another, and the projecting portion has at a tip end thereof a vertex point or a curved surface.

3. An image forming apparatus according to claim 1, wherein let a maximum value of a radius from rotation axes of the first and second sensing shafts to outer ends of the first and second light-shielding plates in a radial direction be R, let a distance between the rotation axes of the first and second sensing shafts be D, let a radius of the first and second sensing shafts be r, let a minimum value of a clearance needed between the first and second sensing shafts in the radial direction be c, let a distance from the rotation axes to a farthest end of a sensing portion of the optical sensor be R1; and let a distance from the rotation axes to a nearest edge of a holding member for the optical sensor be R2, then the following expressions are both fulfilled:

$$R \leq D - r - c \quad \text{Expression (1)}$$

$$R1 < R < R2 \quad \text{Expression (2)}$$

4. An image forming apparatus according to claim 3, wherein the maximum value R of the radius fulfills both of the following expressions:

$$R = D - r - c \quad \text{Expression (3)}$$

$$R = (R1 + R2)/2 \quad \text{Expression (4)}$$

5. An image forming apparatus according to claim 1, wherein the remaining quantity sensing portion counts the numbers of revolutions based on the output signal yielded when the optical path of the optical sensor starts being shielded, or ceases being shielded, by the first or second light-shielding plate.

* * * * *